United States Patent [19]

Miechur

[11] Patent Number: 4,460,210

[45] Date of Patent: Jul. 17, 1984

[54] LIFTING DEVICE

[76] Inventor: Joseph W. Miechur, R.D. #1 Box 91, Slatington, Pa. 18080

[21] Appl. No.: 415,528

[22] Filed: Sep. 7, 1982

[51] Int. Cl.[3] ..... B66C 1/44

[52] U.S. Cl. ..... 294/97

[58] Field of Search ..... 294/97, 62 A, 103 CG, 294/95, 93, 94, 79, 80, 86.24, 86.25, 87.18, 106, 115, 113, 118

[56] References Cited

U.S. PATENT DOCUMENTS 1,357,099 10/1920 Land et al. ..... 294/97

2,670,233 2/1954 Barchoff ..... 294/97

2,809,070 10/1957 Nelson ..... 294/97

3,104,126 9/1963 Lovash ..... 294/97

*Primary Examiner*—James B. Marbert

*Attorney, Agent, or Firm*—Ruth Moyerman

[57] ABSTRACT

A device for lifting objects with an annular opening is disclosed. A handle mounted within a housing is linked to legs. When the handle is moved vertically up or down, the legs are extended or retracted. A locking mechanism provides a means to maintain the legs in a retracted position for easy insertion into the annular opening.

9 Claims, 5 Drawing Figures

LIFTING DEVICE

BACKGROUND OF THE INVENTION

1. Field of the Invention

This invention relates to handling implements and more particularly to plate and receptacle lifters.

2. Description of the Prior Art

Many devices have been proposed and patented over the years for lifting objects with annular openings. U.S. Pat. No. 1,277,716 to Grosvenor discloses a device for lifting tire cores and U.S. Pat. No. 2,634,156 to Crimmel discloses a device for lifting hollow objects such as railroad wheel tires. These devices have limitations inherent in their design. The object to be lifted is secured by gravity pulling downward on the object and outward pressure of the legs. Thus, the greater the mass of the object to be lifted, the more massive the structure of the lifting device must be constructed. Furthermore, difficulties may be encountered when these prior art devices are inserted into small diameter annular openings because of their, of necessity, large size.

SUMMARY OF THE INVENTION

The aforementioned prior art problems are overcome by the lifting device of this invention. The lifting device has a housing through which a handle is mounted. A pair of legs is mounted on the sides of the handle in a cantilever configuration by means of links attached at one end to the legs and at the other end to the handle.

The upper end of the handle has an opening through which a crane hook, for example, can be inserted. The lower ends of the legs have horizontal extensions to stabilize an object mounted on the legs. The upper ends of the legs have an oblique bend which is located adjacent the housing. Studs mounted at the bends on both sides of the leg extend through slots located on both sides of the housing. These slots are parallel to the upper ends of the legs and guide the extension and retraction of the legs as the handle is moved vertically within the housing.

A locking mechanism comprised of a pin located on the top of the housing and a ball plunger mounted in a collar on the handle provides a means for locking the legs in a retracted position. The device may then be inserted into the annular opening of the device to be lifted. After insertion of the device into the object, the legs are extended to engage the interior surfaces of the object by downward force on the grasping mechanism located on the front surfaces of the housing as the handle is moved upward. Upward movement of the handle results in outward movement of the legs and engagement of the legs with the object's interior surface. If the object has an annular opening extending through the bottom, the horizontal extensions of the legs engage the bottom exterior surface and thereby secure the object to the lifting device. If the annular opening does not extend through the bottom surface, serrated edges may be mounted on the outside surfaces of the legs which provide frictional engagement between the legs and object's interior surfaces.

It is therefore an object of this invention to provide a device which lifts objects having an annular opening and interior surface.

It is another object of this invention to provide a device to lift objects having a large mass weight such as coils of metal and paper.

It is yet another object of this invention to provide a lifting device which can be easily inserted and removed from the object.

These and other objects will be more readily ascertainable to one skilled in the art by reference to the accompanying drawing and exemplary embodiments that follow.

BRIEF DESCRIPTION OF THE DRAWING(S)

DETAILED DESCRIPTION OF THE PREFERRED EMBODIMENT(S)

Figure 1:
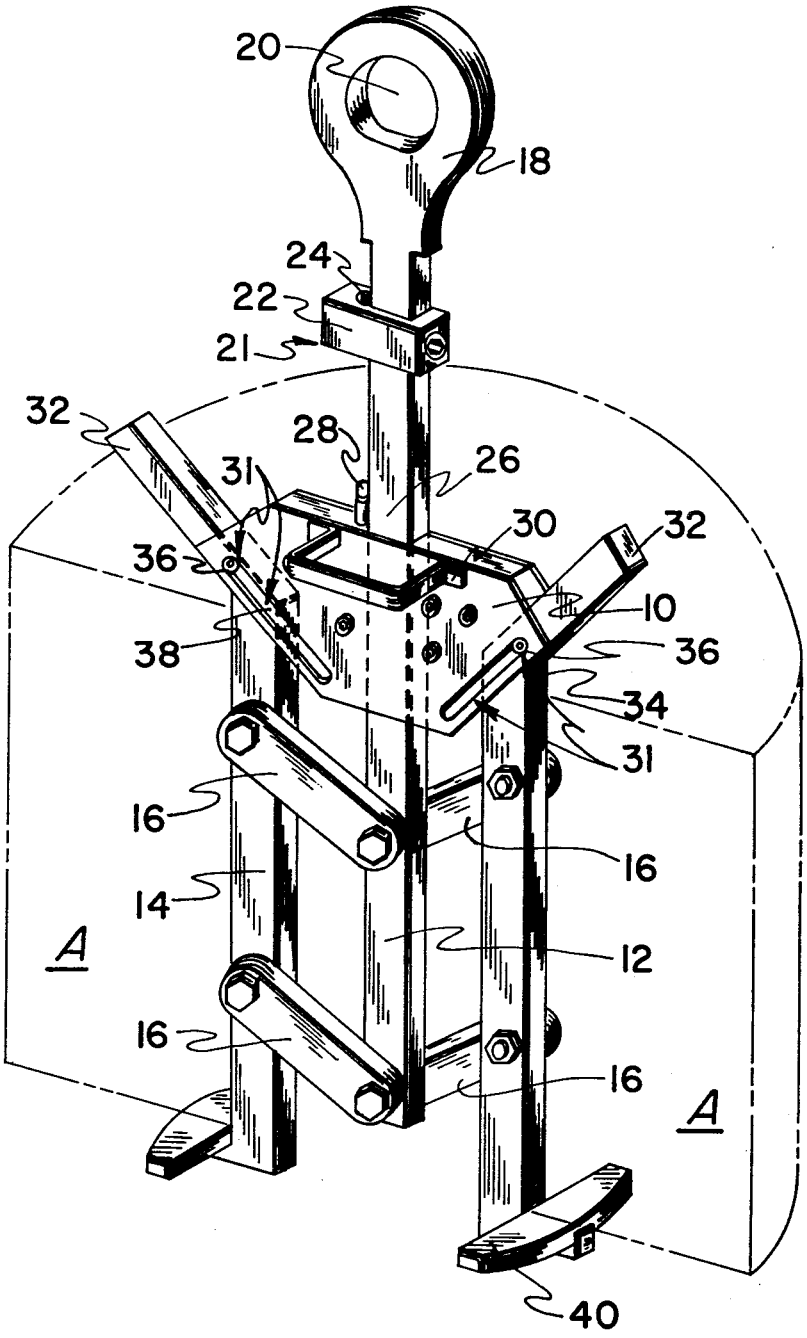
FIG. 1 is a elevation of the device shown engaging the interior annular surfaces of an object.

Referring now to FIG. 1, housing 10 is shown with handle 12 passing through and linked to legs 14 by links pairs 16. Located at the distal end of handle 12 is a graspable terminus 18 having an aperture 20 through which, for example, a crane hook can be inserted to lift the device. Locking mechanism 21 is shown with collar 22 having bore 24 mounted on handle shank 26 and round headed pin 28 is mounted on top surface of housing 10.

Grasping means 30 is mounted on the front of housing 10 and provides means to engage and disengage locking mechanism 21. Guide mechanism 31 is shown with leg upper terminus 32 having oblique bend 34. Stud 36 mounted proximate to bend 34 protrudes through slot 38 and prevents hyperextension of legs 14 because of the predetermined length of slot 38. Horizontal extensions 40 of legs 14 are shown engaging the bottom surface of an object, generally A.

Figure 2:
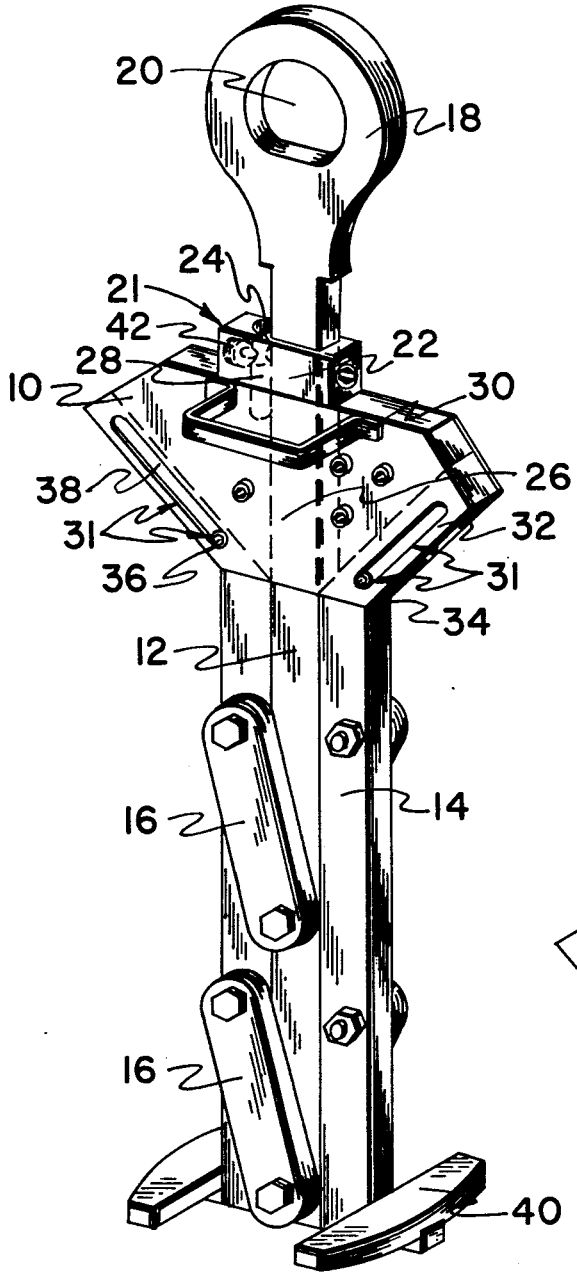
FIG. 2 is a elevation of the device shown with the legs locked in a retracted position.

Referring now to FIG. 2, legs 14 are shown in the retracted position for removal or insertion into an object. Locking mechanism 21 is shown with round headed pin 28 engaged by ball plunger 42 while positioned within bore 24 located in collar 22.

Handle 12 having graspable terminus 18 and aperture 20 is shown with handle shank 26 retracted through housing 10. Guide mechanism 31 is shown with studs 36 mounted on oblique bend 34 of upper leg terminus 32. Slots 38 guide the legs 14 via studs 36 when handle shank 26 is retracted into housing 10. Link pairs 16 are shown in the retracted position. Retraction of legs 14 facilitates insertion and withdrawal of the lifting devide from an annular interior by simultaneous retraction of horizontal extensions 40. Grasping means 30 is depicted in more detail in FIG. 3.

Figure 3:
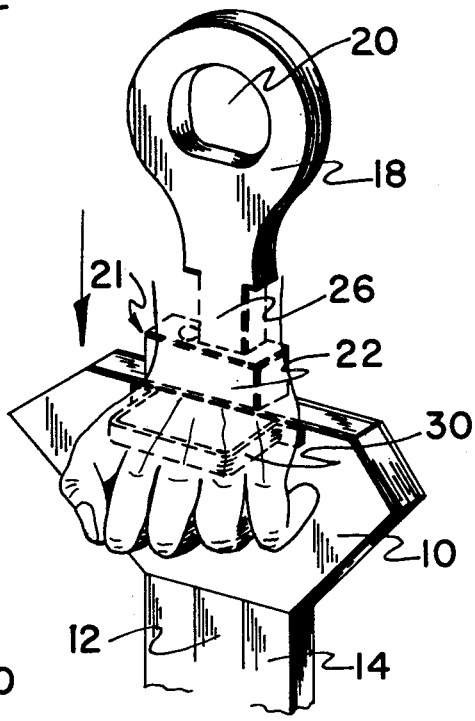
FIG. 3 is a fragmentary closeup of the handle and grasping mechanism.

Referring now to FIG. 3, handle 12 is shown with graspable terminus 18 having aperture 20 and handle shank 26. Collar 22 is shown mounted on handle shank 26. Housing 10 is shown with grasping means 30. Downward longitudinal force of a hand on grasping means 30 results in disengagement of locking mechanism 21 and extension of legs 14. Similarly, upward longitudinal force of a hand on grasping means 30 results in retraction of legs 14 and engagement of locking mechanism 21.

Figure 4:
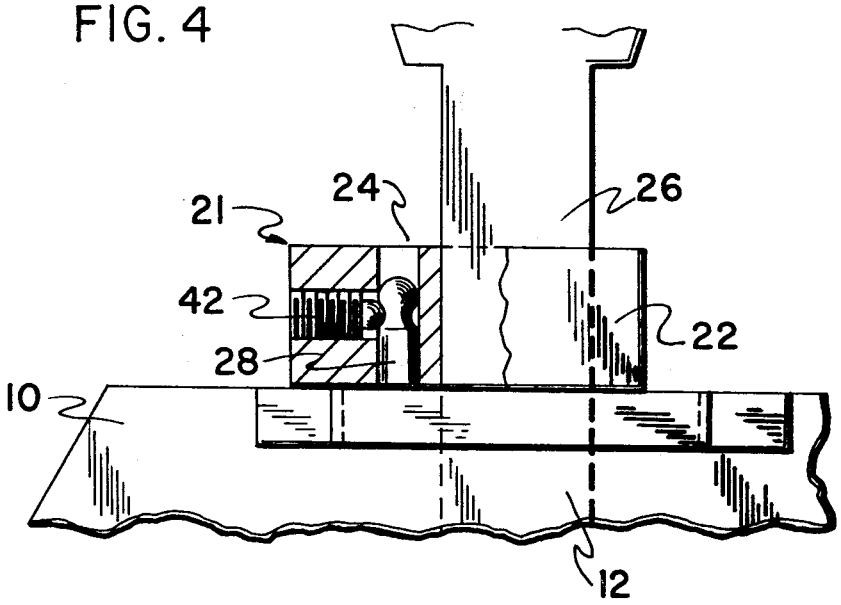
FIG. 4 is a fragmentary cross section of the locking mechanism.

Referring now to FIG. 4, a closeup cross section of locking mechanism 21 is shown. Collar 22 mounted on handle shank 26 is shown with ball plunger 42 and bore 24. Round headed pin 28 mounted on housing 10 is shown engaging ball plunger 42 within bore 24. Handle 12 is prevented from longitudinal movement by the function of locking mechanism 21 until forceably released as shown in FIG. 3.

Figure 5:
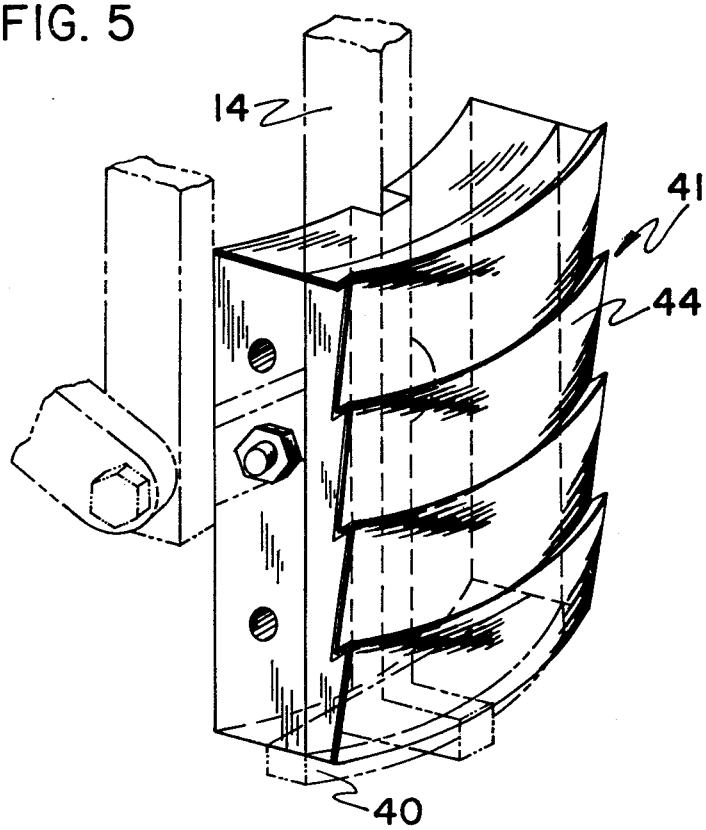
FIG. 5 is a fragmentary view of an alternate embodiment showing the serrated edges.

Referring now to FIG. 5, an alternate embodiment is disclosed with legs 14 shown having horizontal extensions 40 on which are mounted filler 41 with serrated edges 44. Serrated edges 44 are used to engage the interior annular surfaces of an object not having a bottom opening, and provide frictional engagement to secure the object to the legs 14.

There are many variations which may be practiced within the scope of this invention. For example, the length of legs 14 and slots 38 may vary depending on the length and diameter of the annular interior of the objects to be lifted. The configuration and size of horizontal extensions 40 may vary depending on the type of object to be lifted. Different configurations of grasping means 30 may be mounted on housing 10. Variations of the locking mechanism 21 include a movable lock pin inserted through handle shank 26 to prevent longitudinal movement of handle 18 or any other lock which would perform the function of releasably holding the handle.

The device of this invention has many advantages. Chief among these is that the weight of the object to be lifted is equally distributed along the vertical axis of the handle, through the legs and therefore the device is suitable for lifting very heavy objects such as steel coil even though the device itself is small and lightweight.

The number of links provided is optional and a function of the desired length of the device.

Secondly, the horizontal extensions on the legs retain an object and prevent it from slipping off the device, but are not required to be load bearing and thus may be relatively small and lightweight.

Lastly, because the lifting thrust is outward, the device can be reduced to a compact size which, in the folded position, provides easy insertion into an object.

Having now described and illustrated my invention, it is not intended that such description limit this invention, but rather that this invention be limited only by a reasonable interpretation of the apended claims.

What is claimed is:

1. A lifting device intended to lift objects with an annular opening by grasping the object at the interior surface of the annulus comprising:

(a) a housing including an opening therethrough to slidably receive a shank of a handle;

(b) a handle having a graspable terminus at its distal end, said handle including a shank sized to slidably pass through said housing;

(c) a pair of legs located on opposing sides and parallel to said handle's shank, said legs upper terminus being movably connected to said housing via a guide mechanism so that longitudinal reciprocating movement of said handle through said housing causes transverse reciprocating movement of said legs to frictionally engage or disengage the annular interior surfaces along the entire length of said legs in linear juxtaposition to said interior surface, of the object to be lifted;

(d) a plurality of pairs of links, each pair pivotably mounted at its one end on opposing sides of said handle's shank below said shank's exit point from said housing and at its other end of to one of said legs; and, (e) a locking mechanism associated with said handle to prevent longitudinal movement of said handle's shank.

2. The device according to claim 1 including horizontal extensions of said leg's lower terminus, whereby objects are retained securely to said legs by engagement of said horizontal extensions with the bottom outside surface of said object to be lifted.

3. The device according to claim 1 wherein said guide mechanism includes an oblique bend of said legs upper terminus and a stud mounted on each side of said legs upper terminus proximate said oblique bend, and wherein said housing includes a slot juxtapositioned with each of said studs to receive said studs, whereby hyperextension of said legs is prevented by the predetermined length of said slot.

4. The device according to claim 1 wherein said locking mechanism includes a round headed pin with a groove circumscribing said pin in close proximity to said round head, said round headed pin being located on said housing top surface parallel to and proximate said shank's entrance, and a ball plunger mounted within a collar having a vertical bore perpendicular to said ball plunger, said collar mounted on said shank of said handle's distal end, wherein engagement of said round headed pin within said bore by said ball plunger prevents longitudinal movement of said handle's shaft through said housing, thereby precluding transverse movement of said legs.

5. The device according to claim 1 including two pairs of links.

6. The device according to claim 1 wherein said graspable terminus includes an aperture in its center, whereby a crane hook may be inserted through said aperture to lift said device by said handle.

7. The device according to claim 1 including, additionally, grasping means mounted on said housing to permit a user to induce engagement and disengagement of said ball plunger.

8. The device according to claim 7 wherein said grasping means includes a rectangular-shaped handle mounted on the front of said housing.

9. The device according to claim 1 including a filler with a serrated side, said filler mounted on the outside of said legs, serrated side exposed, whereby annular objects without a bottom opening may be securely retained to said legs due to frictional engagement between said serrated edges and annular interior surfaces.

* * * * *